US007346938B2

(12) United States Patent
Mattson, Jr. et al.

(10) Patent No.: US 7,346,938 B2
(45) Date of Patent: Mar. 25, 2008

(54) RETROFIT SUCTION SANITATION SAFETY COVER

(75) Inventors: Roy W. Mattson, Jr., 1732 Spencer St., Longmont, CO (US) 80501; Paulette C. Ogden, 1732 Spencer St., Longmont, CO (US) 80501; Philip I. Ogden, Longmont, CO (US)

(73) Assignees: Roy W. Mattson, Jr., Longmont, CO (US); Paulette C. Ogden, Longmont, CO (US)

( * ) Notice: Subject to any disclaimer, the term of this patent is extended or adjusted under 35 U.S.C. 154(b) by 395 days.

(21) Appl. No.: 10/934,230

(22) Filed: Sep. 3, 2004

(65) Prior Publication Data

US 2005/0091740 A1 May 5, 2005

Related U.S. Application Data

(60) Continuation-in-part of application No. 10/797,252, filed on Mar. 10, 2004, now abandoned, which is a division of application No. 10/211,497, filed on Aug. 2, 2002, now Pat. No. 6,760,931.

(60) Provisional application No. 60/571,593, filed on May 17, 2004, provisional application No. 60/499,585, filed on Sep. 3, 2003.

(51) Int. Cl.
*E04H 4/00* (2006.01)

(52) U.S. Cl. ..... 4/507; 4/490; 4/504; 4/509

(58) Field of Classification Search ..... 4/490, 4/504, 507, 509, 541.1, 541.3; 210/167, 210/169, 198.1, 206, 416.1, 748, 416.2
See application file for complete search history.

(56) References Cited

U.S. PATENT DOCUMENTS 306,111 A 7/1884 Genese
487,130 A 11/1890 Schoeng
571,276 A 11/1896 Maxwell
647,895 A 4/1900 Burson
676,763 A 6/1901 Nelson
967,368 A 8/1910 Wiugrigby
1,494,882 A 5/1924 Barger
1,594,400 A 8/1926 Wuest
1,618,679 A 2/1927 Schifter
1,880,962 A 10/1932 Koppelman (Continued)

FOREIGN PATENT DOCUMENTS

CA 2430169 2/2004

*Primary Examiner*—Tuan Nguyen

(57) ABSTRACT

A safety cover having a filter and an optional chemical dispenser, that covers and existing faceplate on a water vessel having a closed loop piping system and water pump. When the cover and filter cover an existing faceplate the cover and filter increases the vacuum on a suction line leading to a water pump by less than 5" Hg. The chemical in the dispenser releases in a metered dose of a substance having antimicrobial properties and the dose is in a sufficient amount to inhibit a growth of a microorganism in at least a segment of a water vessel. The combination of cover, filter and chemical chamber are disposable, or the filter is replaceable and the chemical in the chemical chamber is replenishable. The cover with filter and chemical chamber or just the cover and chemical chamber, or just the cover and filter are retrofitable to any existing faceplate on a water vessel having a closed looped piping system and a water pump. The cover having a filter prevents hair from becoming entrapped in an existing faceplate, as the filter creates a barrier between the inventive cover and the existing faceplate. The cover also has various means to keep the cover secured over the existing faceplate until a user decides to removes it.

13 Claims, 7 Drawing Sheets

U.S. PATENT DOCUMENTS

| | | | |
|---|---|---|---|
| 2,073,784 | A | 3/1937 | Day |
| 2,093,980 | A | 9/1937 | Liuger |
| 2,218,388 | A | 10/1940 | Twombly |
| 2,234,397 | A | 3/1941 | Bentz |
| 2,247,116 | A | 6/1941 | Day |
| 2,309,987 | A | 9/1943 | Goodloe |
| 2,367,794 | A | 1/1945 | Marselus |
| 2,546,874 | A | 3/1951 | Siegrist |
| 2,709,489 | A | 5/1955 | Keebler |
| 2,759,771 | A | 8/1956 | Bauer |
| 2,835,328 | A | 5/1958 | Thompson |
| 2,865,511 | A | 12/1958 | Hopkins |
| 2,877,852 | A | 3/1959 | Bashara |
| 3,057,481 | A | 10/1962 | Pall |
| 3,263,811 | A | 8/1966 | Baker et al. |
| 3,385,445 | A | 5/1968 | Burheggen et al. |
| 3,422,183 | A | 1/1969 | Ellison |
| 3,572,458 | A | 3/1971 | Ehe |
| 3,614,952 | A | 10/1971 | Anwelling |
| 3,631,987 | A | 1/1972 | Cafiano, Sr. |
| 3,745,594 | A | 7/1973 | Cosper |
| 3,976,571 | A | 8/1976 | Rio |
| 4,052,318 | A | 10/1977 | Krebs |
| D249,955 | S | 10/1978 | Vogelsang |
| 4,168,557 | A | 9/1979 | Rasch et al. |
| 4,180,473 | A | 12/1979 | Maurer et al. |
| 4,233,694 | A | 11/1980 | Janosko et al. |
| 4,257,893 | A | 3/1981 | Burton |
| 4,293,414 | A | 10/1981 | Gianneli |
| 4,340,039 | A | 7/1982 | Hibbard et al. |
| 4,349,434 | A | 9/1982 | Jaworski |
| 4,359,790 | A | 11/1982 | Chalberg |
| 4,362,623 | A | 12/1982 | Holopanen |
| 4,426,286 | A | 1/1984 | Puckett et al. |
| 4,533,476 | A | 8/1985 | Wakins |
| 4,552,658 | A | 11/1985 | Adcock et al. |
| 4,584,106 | A | 4/1986 | Held |
| D286,319 | S | 10/1986 | Mathis |
| 4,630,634 | A | 12/1986 | Sasaki et al. |
| 4,637,873 | A | 1/1987 | DeSousa et al. |
| 4,658,449 | A | 4/1987 | Martin |
| D290,166 | S | 6/1987 | Jacuzzi |
| D290,167 | S | 6/1987 | Jacuzzi |
| 4,676,396 | A | 6/1987 | Mamolou |
| 4,676,894 | A | 6/1987 | Diamond et al. |
| 4,692,314 | A | 9/1987 | Etani |
| 4,761,208 | A | 8/1988 | Gram et al. |
| D299,522 | S | 1/1989 | Chalberg |
| 4,798,028 | A | 1/1989 | Pinion |
| 4,818,389 | A | 4/1989 | Tobias et al. |
| 4,935,132 | A | 6/1990 | Schaier |
| 4,971,687 | A | 11/1990 | Anderson |
| D318,001 | S | 7/1991 | Gavin et al. |
| 5,035,800 | A | 7/1991 | Kopach |
| 5,167,041 | A | 12/1992 | Burkitt, III |
| D333,755 | S | 3/1993 | Oleksiuk |
| 5,202,020 | A | 4/1993 | Desjoyaux et al. |
| 5,236,581 | A | 8/1993 | Perry |
| 5,252,211 | A | 10/1993 | Searfoss, Jr. |
| 5,277,802 | A | 1/1994 | Goodwin |
| 5,304,305 | A | 4/1994 | Lehrer |
| 5,328,602 | A | 7/1994 | Brooks |
| 5,347,664 | A | 9/1994 | Hamza et al. |
| 5,372,714 | A | 12/1994 | Logue, Jr. |
| 5,383,239 | A | 1/1995 | Mathis et al. |
| 5,392,773 | A | 2/1995 | Bertrand |
| 5,409,608 | A | 4/1995 | Yoshida et al. |
| 5,453,183 | A | 9/1995 | Hoffa |
| 5,486,287 | A | 1/1996 | Murphy et al. |
| 5,507,948 | A | 4/1996 | Wargo et al. |
| 5,536,393 | A | 7/1996 | Weeks |
| 5,656,159 | A | 8/1997 | Spencer et al. |
| 5,681,988 | A | 10/1997 | Koch et al. |
| 5,728,293 | A | 3/1998 | Guoli et al. |
| 5,743,287 | A | 4/1998 | Rauchwerger |
| 5,755,962 | A | 5/1998 | Gershenson et al. |
| 5,762,797 | A | 6/1998 | Patrick et al. |
| 5,779,913 | A | 7/1998 | Denkewicz, Jr. et al. |
| 5,799,339 | A | 9/1998 | Perry et al. |
| 5,810,999 | A | 9/1998 | Bachand et al. |
| 5,824,218 | A | 10/1998 | Gasser et al. |
| 5,853,581 | A | 12/1998 | Rayborn et al. |
| 5,857,594 | A | 1/1999 | Ozturk |
| 5,862,545 | A | 1/1999 | Mathis et al. |
| 5,863,431 | A | 1/1999 | Salzburg |
| 5,868,933 | A | 2/1999 | Patrick et al. |
| 5,888,384 | A | 3/1999 | Wiederhold et al. |
| 5,888,392 | A | 3/1999 | Frizell |
| 5,928,510 | A | 7/1999 | Meredith |
| 5,930,852 | A | 8/1999 | Grauaff et al. |
| 5,954,952 | A | 9/1999 | Strawser, Sr. |
| 5,976,370 | A | 11/1999 | Medworth |
| 5,976,385 | A | 11/1999 | King |
| 5,980,740 | A | 11/1999 | Harms et al. |
| 6,019,893 | A | 2/2000 | Denkewicz, Jr. et al. |
| 6,038,712 | A | 3/2000 | Chalberg et al. |
| D424,369 | S | 5/2000 | Bielfeldt et al. |
| 6,065,161 | A | 5/2000 | Mateina et al. |
| 6,066,253 | A | 5/2000 | Idland et al. |
| D428,155 | S | 7/2000 | Chalberg et al. |
| 6,102,657 | A | 8/2000 | Chalberg et al. |
| 6,132,603 | A | 10/2000 | Mokrzycki |
| 6,138,703 | A | 10/2000 | Ferguson et al. |
| 6,153,095 | A | 11/2000 | Francisco |
| 6,165,358 | A | 12/2000 | Denkewicz, Jr. et al. |
| 6,170,095 | B1 | 1/2001 | Zars |
| 6,171,496 | B1 | 1/2001 | Patil |
| 6,173,455 | B1 | 1/2001 | Nordstrom |
| 6,190,547 | B1 | 2/2001 | King et al. |
| 6,221,242 | B1 | 4/2001 | Deibel et al. |
| 6,228,274 | B1 | 5/2001 | Deibel et al. |
| 6,270,662 | B1 | 8/2001 | Gibson et al. |
| 6,274,036 | B1 | 8/2001 | Ellis |
| 6,276,551 | B1 | 8/2001 | Miller, II |
| 6,280,617 | B1 | 8/2001 | Brandreth, III |
| 6,283,308 | B1 | 9/2001 | Patil et al. |
| 6,294,095 | B1 | 9/2001 | Lewis |
| 6,308,350 | B1 | 10/2001 | Marchionda |
| 6,328,900 | B1 | 12/2001 | King |
| 6,331,432 | B1 | 12/2001 | Bautista et al. |
| D452,633 | S | 1/2002 | Valkovich |
| 6,340,431 | B2 | 1/2002 | Khan |
| 6,358,405 | B1 | 3/2002 | Leahy |
| D455,608 | S | 4/2002 | McWilliams |
| 6,390,340 | B1 | 5/2002 | Lynch, Sr. |
| 6,395,167 | B1 | 5/2002 | Mattson, Jr. et al. |
| 6,405,387 | B1 | 6/2002 | Barnes |
| 6,409,864 | B1 | 6/2002 | Choi |
| 6,415,509 | B1 | 7/2002 | Echols et al. |
| 6,440,303 | B2 | 8/2002 | Spriegel |
| 6,443,715 | B1 | 9/2002 | Mayleben et al. |
| 6,460,894 | B1 | 10/2002 | Weh et al. |
| 6,537,448 | B2 | 3/2003 | Hook |
| 6,540,916 | B2 | 4/2003 | Patil |
| 6,558,538 | B2 | 5/2003 | Scuilla et al. |
| 6,568,539 | B1 | 5/2003 | Deibel et al. |
| 6,576,032 | B2 | 6/2003 | Maus |
| 6,588,029 | B2 | 7/2003 | Mullins |
| 6,614,481 | B1 | 9/2003 | Bode |
| 6,623,634 | B1 | 9/2003 | Whitehurst |
| 6,641,787 | B1 | 11/2003 | Siggins et al. |
| 6,651,825 | B2 | 11/2003 | Turner, Jr. et al. |
| 6,666,974 | B2 | 12/2003 | Page |
| 6,676,842 | B2 | 1/2004 | Scuilla et al. |

6,685,843 B2 2/2004 Leaverson
6,688,490 B2 2/2004 Carlson
6,698,035 B1 3/2004 Grueser
6,716,361 B2 4/2004 Deibel et al.
6,722,384 B2 4/2004 Gates
6,749,746 B2 6/2004 Mokrzycki
6,760,931 B1 7/2004 Mattson et al.
D494,811 S 8/2004 Rossi
6,780,316 B2 8/2004 Haynes et al.
6,792,925 B2 9/2004 Dworatzek et al.
6,797,028 B2 9/2004 Duffy
6,797,166 B1 9/2004 Hambley et al.
6,799,686 B2 10/2004 Echols et al.
6,802,962 B1 10/2004 Brown, III et al.
2001/0003217 A1 6/2001 Sorenson
2001/0013373 A1 8/2001 Wright
2002/0113025 A1 8/2002 Gauldin et al.
2002/0117432 A1 8/2002 Lincke et al.
2003/0146105 A1 8/2003 Shivelin-Ren et al.
2003/0146144 A1 8/2003 Votell
2004/0069695 A1 4/2004 Isobetakashi et al.
2004/0173517 A1 9/2004 Yuan
2004/0185346 A1 9/2004 Clive et al.

RETROFIT SUCTION SANITATION SAFETY COVER

CROSS RELATED APPLICATIONS

This is a Continuation In Part of U.S. Utility patent application Ser. No. 10/797,252 filed Mar. 10, 2004 now abandon titled Suction Filter Sanitation Device, which is a divisional of U.S. Utility patent application Ser. No. 10/211,497 titled Non-Electrical Sanitation System filed Aug. 2, 2002, and now U.S. Pat. No. 6,760,931, and additionally claiming the benefits of U.S. Provisional Patent Application No. 60/499,585 filed Sep. 3, 2003 titled Retrofit Whirlpool Bathtub Bacteria Inhibiting Sanitation Assembly, U.S. Provisional Patent Application No. 60/571,593 filed May 17, 2004 titled Retrofit Substance Dispenser for Whirlpool Bathtub Faceplate and Safety Packaging Methods, and U.S. Provisional Patent Application No. 60/571,593 filed May 17, 2004 titled Improved Retrofit Substance Dispenser for Whirlpool Bathtub Faceplate and Safety Packaging Methods.

FIELD OF INVENTION

The present invention relates to combining an antimicrobial dispenser and a filter with a suction cover for a water vessel having a closed loop piping system and a water pump, whereby the cover, covers an existing suction fitting faceplate.

BACKGROUND OF THE INVENTION

Whirlpool-type baths have been employed to treat discomfort resulting from strained muscles, joint ailments and the like. More recently, such baths have been used increasingly as means of relaxing from the daily stresses of modern life. A therapeutic effect is derived from bubbling water and swirling jet streams that create an invigorating hydro massage of the user's body.

To create the desired whirlpool motion and hydro massage effect, a motorized water pump draws water through a suction fitting in a receptacle, such as a bathtub. The user first fills the bathtub. Then the user activates the closed loop whirlpool system. The closed looped plumbing system is considered to be all parts of a whirlpool bathtub that cannot be opened for cleaning. Thus, the jets, pump, piping system, air controls, sanitation suction device and the like and all components that cannot be opened for cleaning from the inline closed looped plumbing system of a whirlpool bath. The water travels through a piping system and back out jet fittings. Jet fittings are typically employed to inject water at a high velocity into a bathtub. Usually the jet fittings are adapted to aspirate air so that the water discharged into the receptacle is aerated to achieve the desired bubbling effect. (See e.g., U.S. Pat. No. 4,340,039 to Hibbard et al., incorporated herein by reference.) Generally, whirlpool baths are designed like a normal bathtub to be drained after each use. However, debris in the form of dead skin, soap, hair and other foreign material circulate throughout the closed loop plumbing system. This debris does not completely drain and over time, it accumulates in the closed loop plumbing system, especially a water pumps impeller. Such debris has been reported by scientists to cause a human health risk.

U.S. Pat. No. 6,395,167 to Mattson, Jr. et al. ("Mattson"), which is incorporated herein by reference discloses the first below the waterline suction filter invention for a water vessel having a closed loop piping system and a water pump.

U.S. Pat. No. 6,751,814 to Mattson, Jr. et al., which is incorporated herein by reference discloses a suction filter also having a chemical cage that augments the germ killing properties of a whirlpool bathtub.

U.S. Pat. No. 6,760,931 to Mattson, Jr. et al., which is incorporated herein by reference discloses a non-electrical sanitation device for a water vessel having a closed loop piping system. The sanitation device has a chemical chamber and a removable filter.

U.S. Utility patent application Ser. No. 10/624,432 to Mattson et al. which is incorporated herein by reference, filed Jul. 22, 2003, discloses a cover having an antimicrobial chamber where the cover covers an existing faceplate of a water vessel.

U.S. Provisional Patent Application 60/499,585 to Mattson et al., which is incorporated herein by reference, filed Sep. 3, 2003, discloses a retrofit bacteria inhibiting sanitation assembly.

U.S. Provisional Patent Application 60/571,593 to Mattson et al., which is incorporated herein by reference, filed May 17, 2004, discloses a retrofit substance dispenser for a suction fitting.

U.S. Utility patent application Ser. No. 10/459,665 filed Jun. 6, 2003 to Selover, which is incorporated herein by reference, discloses a faceplate having a chemical chamber extending from the rearward side of the faceplate and extending into a suction housing. Selover's disclosure is also restricted to a chemical chamber having a single inlet opening and a single outlet opening (two openings) whereby water must travel through the entire chemical chamber to release a chemical. The current invention's chemical chamber does not extend into a suction housing and has one or more openings, but preferably a single opening, to release a chemical without water having to travel through the entire chemical chamber. The present invention therefore, can hold more chemical for its size compared to the Selover chemical chamber, as extra room is needed in the Selover chemical chamber to provide for water flow through. Selover also does not disclose that his chemical chamber releases enough chemical to inhibit bacteria in any segment of a water vessel. In one embodiment of the present invention discloses and claims to release a sufficient amount of chemical to inhibit bacteria growth. Selover does not provide any means to attach his cover to a whirlpool bathtub and his disclosure provides only for an invention that covers a suction housing and not an existing suction faceplate. Additionally, Selover does not disclose a filter.

U.S. Pat. No. 6,066,253 issued May 23, 2000 to Idland et al., which is incorporated herein by reference, discloses a pleated filter attached to the front side of a faceplate. The filter extends substantially into a tub where a user may kick the filter and break the filter. The filter additionally takes up a substantial amount of space in a tub. In one embodiment of the present invention the present invention's filter does not extend substantially into a tub. The Inland filter does not cover all the openings in the faceplate and therefore water may bypass the filter. Bacteria and debris collect on a filter therefore; keeping a filter where it is not readily exposed to a bath user is desirable. Idland's filter is entirely exposed to a user. In one embodiment of the present invention the present invention's filter is not readily exposed to a user. Further, the present invention, combination cover and filter covers an existing faceplate and the configuration of the present invention provides that no hair can become entrapped in the existing faceplate the present invention covers. The configuration of the Idland invention does not provide this safeguard. In fact, as disclosed, the Inland filter and the faceplate it is attached to might entangle a user's hair because the filter is exposed and extends substantially into a tub. The Inland filter does not provide a barrier between a user and all the openings in a faceplate and the current invention does so. More importantly, the Inland invention as disclosed provides that water could enter through the faceplate and by pass the filter. In the current invention, all water passing through the cover passes through the filter. With the current invention, if the filter were placed on the front surface of the cover, the filter would cover all openings in the cover and no water would bypass the filter. The current invention's filter if placed rearward of the cover provides that all water is filtered before entering an existing faceplate. U.S. Pat. No. 4,359,790 issued Nov. 23, 1982 to Chalberg, which is incorporated herein by reference discloses a standard suction fitting having a faceplate. U.S. Provisional Patent Application No. 60/571,593 to Mattson, Jr. et al., which is incorporated herein by reference, discloses a suction chemical dispensing device.

In one embodiment the present invention provides for a ventilated cover, structure or member that covers and/or is retrofitable to a below the waterline suction faceplate for a water vessel having a closed looped piping system and a water pump. In one embodiment the present invention incorporates a filter. One embodiment of the current invention also provides an antimicrobial dispenser whereby the antimicrobial and the filter can be replaced or the antimicrobial replenished without having to remove the existing faceplate from a suction housing. In one embodiment the current invention is slightly larger than the existing faceplate it covers. One embodiment of the current invention has the chemical chamber attached to the front surface of the cover and not rearward of the cover. This arrangement is not known in prior art and provides several benefits. First, the chemical chamber can be made of any size, which is not the case with a rearward extending chemical chamber. One embodiment of the present invention is designed to cover and existing faceplate. In one embodiment of the present invention because of size constraints it is difficult to place a chemical chamber of sufficient size that lasts a polarity of bath cycles that fits between the inventive cover and an existing faceplate. The embodiment of the current invention with the chemical chamber mounted to the front surface of the cover solves this problem. One embodiment of the current inventions cover has a chemical chamber attached to the front surface of the cover and the cover is designed to fit a suction housing and not to cover an existing faceplate.

The combination of the ventilated cover, filter and chemical chamber are disposable. One embodiment of the current invention the ventilated cover, filter and chemical chamber are not disposable and the filter is replaceable and the chemical housed in the antimicrobial chamber is replenishable.

One embodiment of the current invention the chemical chamber is calibrated to release about a metered dose of a chemical. The release of a metered dose of chemical in one embodiment is accomplished by sizing the release opening or release openings for given water flow impacting the chemical. In one embedment of the current invention, it is preferable that the chemical dose released is under about 6 parts per million in concentration after mixing with water in a tub having a bath cycle under one hour in duration. A person schooled in the art would know how to accomplish this goal. However, there are many another ways the chemical chamber could be configured to release a metered dose and they all would fall into the scope of the current invention. One embodiment of the current invention has a filter that stretches to conform about to the shape of the faceplate it covers. One embodiment of the current invention has an antimicrobial impregnated into the filter. One embodiment of the current invention utilizes a Velcro® type attachment to secure the cover to a tub wall. The current invention could also be formed to snuggly fit an existing faceplate or use any other form of attachment means. The Velcro® type attachment is only mentioned by way of example and not limitation. Covering any suction faceplate with a filter will restrict output jet performance somewhat. When covering an existing suction fitting faceplate the current invention will not increases a vacuum of a suction line by more than 5" Hg. When covering an existing suction fitting faceplate the current invention will not decrease an output jet pressure by more than 35%. One embodiment of the current invention the filter media stretches. This filter media will let small organics pass through the filter, however this media will trap hair and larger debris that provides a source for rapid bacteria growth in a closed loop piping system. As the filter accumulates debris, water suction pressure from the pump stretches the filter media increasing the size of the pores in the filter media. The larger the pore openings the less restriction to the output jets and less vacuum on the suction line leading to the pump. Another advantage of utilizing a stretchable media is that one size media will cover all existing faceplates. Without a stretchable media a filter sized to conform to the shape of an existing faceplate would need to be used for various shapes and sizes of faceplates. One embodiment of the current invention uses a non-stretchable filter media. This media has pore openings sized to collect large debris in the filter media yet is balanced to limit the pressure restriction to the output jets. One of ordinary skill in the art would know how to size the filter media pore sizes for given water flow rates and the goal of inhibiting debris while limiting the restriction out the output jets from this disclosure. In one embodiment of the current invention the amount of chemical released is sufficient to stay in the closed loop plumbing system after water drain down of the water vessel. This helps to inhibit bacteria growth between water vessel pump activation. The chemical could also stay in the closed loop piping system until all the water in the closed loop plumbing system evaporates. This provides that bacteria growth is inhibited between the water vessel usages.

It is well known that people's hair have become entrapped in suction faceplates that are located under the waterline and they have drowned. Since the filter on one embodiment of the present invention is sandwiched between the existing faceplate and the new cover, it is all but impossible for a person to get their hair entrapped in the faceplate the current invention covers. The standard for suction fittings is titled, Suction Fittings for Use in Swimming Pools, Spas, Hot Tubs, and Whirlpool Bathtub Appliances (ASME/IAMPO reaffirm 1996), and this standard is incorporated by reference in all previous Mattson patents. The standard states that a tool is needed to remove a faceplate from a suction housing. A screw driver is the tool of choice. If a user gets their hair entrapped in a standard suction faceplate that meets this industry standard, they would have a hard time finding a tool fast enough to remove the faceplate. The filter of the present invention provides a barrier between the current invention's cover and an existing faceplate preventing a user's hair from getting entangled in the existing faceplate. Therefore, one embodiment of the current invention provides a safety cover that prevents hair from getting entrapped in an existing faceplate. If a user's hair for some reason where to get entrapped in the current invention's hair entrapment resistant cover, the cover not needing a tool for removal, is easily removable and thus, the a user could elevate their head above the waterline and then remove their hair from the cover.

The term chemical used herein means any substance, element or antimicrobial that inhibits a growth of a micro-organism. The term filter used herein means any type of filter that inhibits large objects from entering a closed loop piping system. The term chemical chamber used herein means a chemical dispenser or any device of any configuration that dispensing a chemical in a metered or non-metered dose. The term cover used herein means any cover or structure providing water flow through and the current invention's cover is not limited to any shape, size or configuration.

A ventilated cover that covers an existing faceplate on a water vessel that incorporates a filter that conforms about to the shape of an existing faceplate it covers and that decreases jet output performance by less than 35%, is not known in the art. Consequently, a ventilated cover or structure that covers an existing faceplate on a water vessel that incorporates a filter that conforms about to the shape of an existing faceplate it covers and that decreases jet output performance by less than 35% and incorporates a chemical dispenser is not known in the art.

SUMMARY OF THE INVENTION

The main aspect of the one embodiment of present invention is to provide a retrofitable cover combining a filter that covers an existing faceplate of a water vessel having a closed loop piping system and a water pump.

Another aspect of one embodiment of the current invention is providing a retrofitable cover combining an antimicrobial dispenser and filter combination to cover a faceplate of a suction fitting in a water vessel having a closed loop piping system and a pump.

Another aspect of the one embodiment of current invention is providing a retrofitable cover combining an antimicrobial dispenser that is attached or integral to the front surface of the cover and not rearward extending from the cover.

Another aspect of one embodiment of the current invention is to provide a chemical dispenser that releases a chemical to inhibit a growth of bacteria formation in at least a segment of the water vessel's closed loop piping system during or/and between water vessel activation.

Another aspect of one embodiment of the current invention is providing a cover combining an antimicrobial dispenser and filter combination apparatus in a water vessel having a closed loop piping system whereby the antimicrobial and filter are replaceable without having to remove an existing faceplate from a suction housing.

Another aspect of one embodiment of the current invention is providing a cover having drainage openings in the lower portion thereof and combining an antimicrobial dispenser and filter combination apparatus in a water vessel having a closed loop piping system, whereby the combination retains less than 6½ ounces of water after drain down of the water vessel.

Another aspect of one embodiment of the current invention is providing a compact chemical chamber having a single chemical release opening whereby water does not have to flow through the entire chemical chamber to release a dose, or metered dose of chemical into water.

Another aspect of one embodiment of the current invention is providing a cover having drainage openings in the lower portion thereof and combining a filter making a combination, in a water vessel having a closed loop piping system, whereby the combination retains less than 2 ounces of water after drain down of the water vessel.

Another aspect of one embodiment of the current invention is providing a cover that resists hair entrapment.

Another aspect of one embodiment of the current invention is providing a filter configured to prevent hair entrapment in an existing faceplate.

Another aspect of one embodiment of the current invention is providing a combination cover, antimicrobial dispenser and filter that accommodates water flow exceeding 70 gallons per minute.

Another aspect of one embodiment of the current invention is providing a combination cover, antimicrobial dispenser and filter that accommodates a water flow exceeding 70 gallons per minute and does not increase a vacuum of a suction line leading to a pump by less than 5" Hg or decreases an output jet pressure by more than 35%

Another aspect of one embodiment of the current invention is providing a combination cover, antimicrobial dispenser and filter where the antimicrobial lasts for a polarity of bath cycles before needing replacement.

Another aspect of one embodiment of the current invention is providing an antimicrobial dispenser that releases about a metered dose of antimicrobial for any given bath capacity or water flow.

Another aspect of one embodiment of the current invention is providing an antimicrobial dispenser that releases an antimicrobial when only a normal bath is taken and a water pump is not activated.

Another aspect of one embodiment of the current invention is to provide a means to alert a user when it is time to replace the chemical chamber or replenish the chemical in the chemical chamber.

Another aspect of one embodiment of the current invention is to provide a filter that is a barrier preventing hair entanglement in an existing faceplate.

Another aspect of one embodiment of the current invention is to provide one or more chemical chambers attached to a cover.

Other aspects of this invention will appear from the following description and appended claims, reference being made to the accompanying drawings forming a part of this specification wherein like reference characters designate corresponding parts in the several views.

DETAILED DESCRIPTION OF THE DRAWINGS

Figure 1:
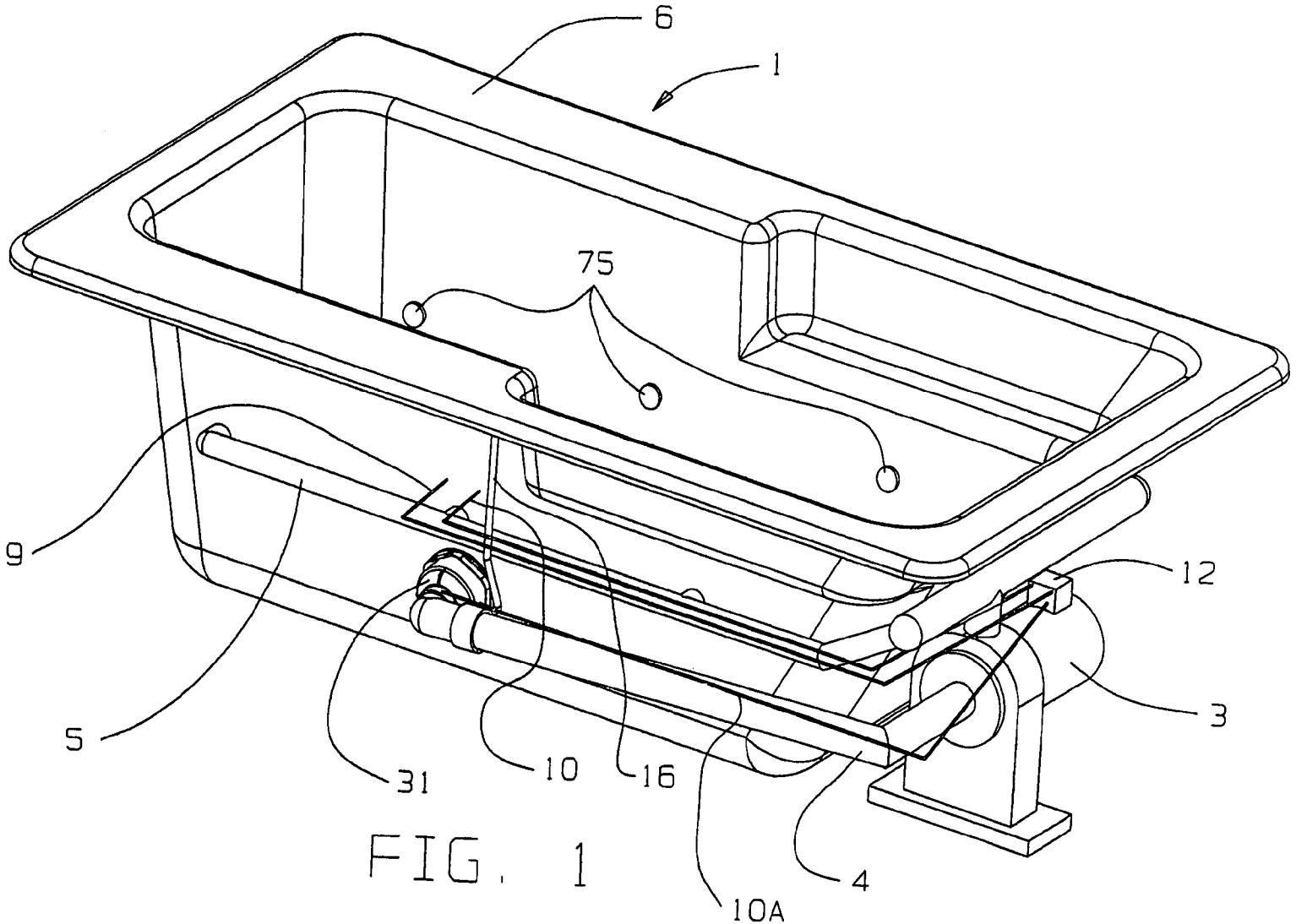
FIG. 1 is a configuration of a standard water vessel having a closed loop piping system.

Referring first to FIG. 1 shows one embodiment of water vessel assembly 1 having tub 6 and output jets 75. Suction fitting 31 draws water from in a tub into suction line 4 and into the pump 3. Pump 3 pumps water through return line 5 into through jets 75 and into tub 6. Suction fitting 31 has faceplate 8 (not shown). Control box 12 activates pump 3. Water vessel assembly 1 is shown with wires 9, 10A and tube 16.

Figure 3:
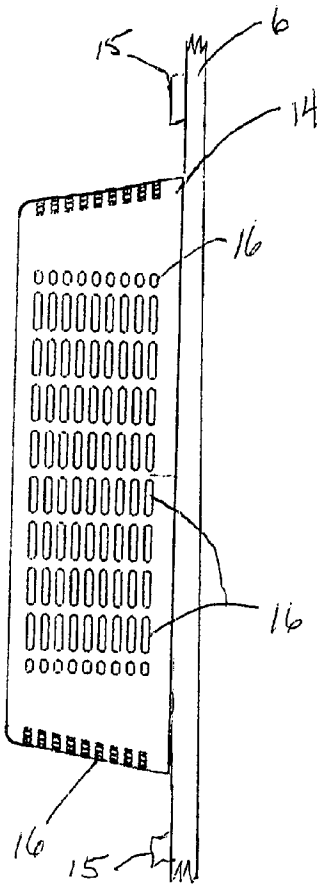
FIG. 3 is a standard existing faceplate attached to a tub wall.
Figure 2:
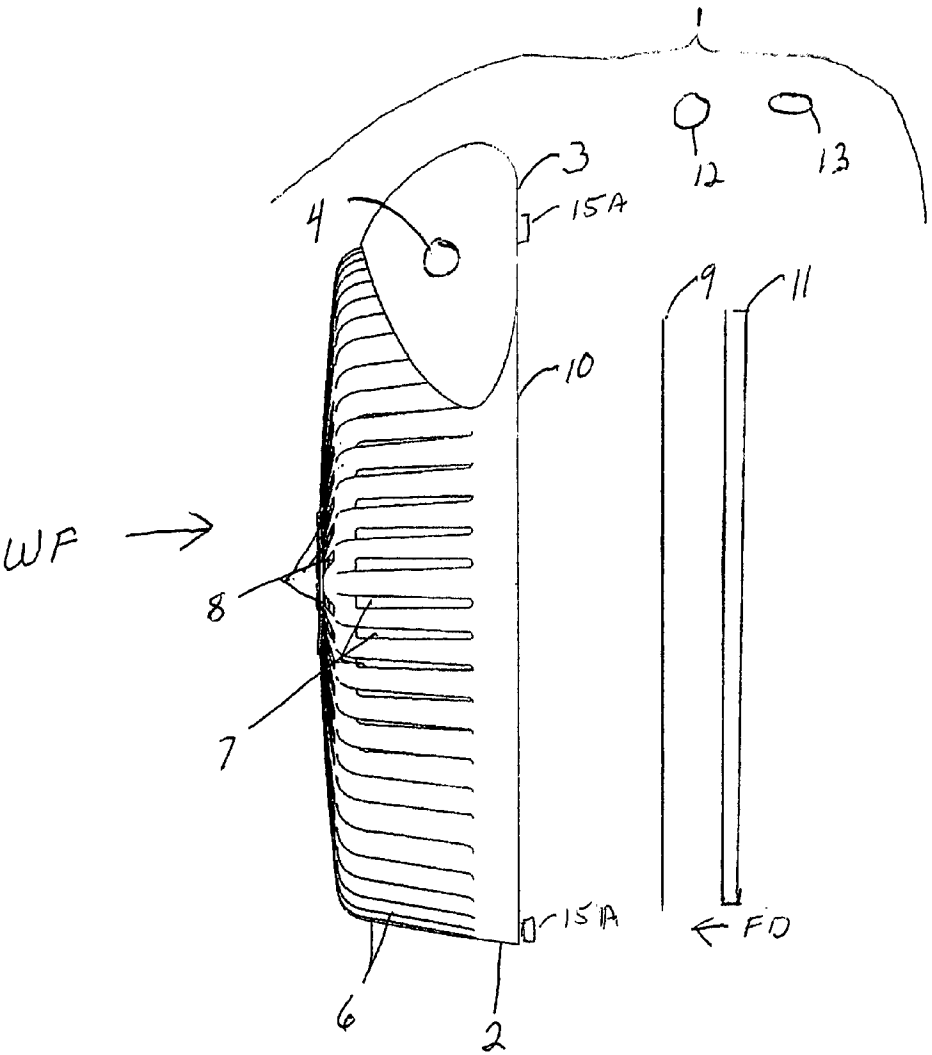
FIG. 2 shows an exploded view of a retrofit cover having a filter and chemical dispenser assembly.

Referring next to FIG. 2 and FIG. 3 In one embodiment of the present invention retrofit assembly 1 has cover 2 with front water flow through openings 8; side water flow through openings 7 and lower water flow through openings 6. Lower water flow through openings provides water drainage for the water vessel (not shown). After water drain down of a water vessel, the combination of cover 2, filter 9 and chemical dispenser 3 retains less than about $6\%_2$ ounces of water and as little as trace amounts of water. Cover 2 is shown by way of example and not limitation. Cover 2 could have one or more openings and the openings could be in any location, size and design. In one embodiment of the present invention chemical dispenser 3 sits on top of cover 2. Chemical dispenser 3 is shown by way of example and not limitation, as chemical dispenser 3 could be located anywhere on the front surface of cover 2. Chemical dispenser 3 could also be integrated with cover 2 or be a separate dispenser that is disposable. Chemical dispenser 3 could have any shape or size. Chemical dispenser 3 has chemical opening 4 to receive chemical 13. Cap 12 secures and is removable from chemical dispenser 3. Chemical opening 4 is shown by way of example and not limitation as the chemical opening 4 could have any shape and be of any size and be in any location on chemical dispenser 3. In one embodiment of the present invention filter media 9 attaches to backside 10 of cover 2. In one embodiment of the present invention filter support 11 secures filter 9 to cover 2. Filter support 11 is shown by way of example and not limitation as there are numerous ways to attach filter 9 to cover 2 and all ways fall into the scope of the current invention. Chemical 13 is shown by way of example and not limitation. Chemical 13 could be of any shape, size or configuration. Chemical 13 could be a tablet, solid or a liquid or any substance or element that provides antimicrobial benefits. In one embodiment of the present invention Velcro® type material 15A secures cover 2 to Velcro® type material 15 on tub wall 6. The Velcro® type material 15 and 15A are shown by way of example and not limitation. Cover 2 could also have suction cups or any other means to secure cover over an existing faceplate. All fastening ways fall into the scope of the current invention. Existing faceplate 14 is installed on tub wall 6 of water vessel 1 (not shown). Cover 2 is designed to slip over existing faceplate 14. Faceplate 14 is provided as an illustration of a standard faceplate and could have any shape, size and configuration. As cover 2 slips over existing faceplate 14. When pump 3 in FIG. 1 is activated, water from tub 1 (not shown) moves in direction WF creating water suction draw through existing faceplate 14. In one embodiment of the present invention water moves in direction WF through cover 2 contacting chemical 13 and a portion of chemical 13 leaves dispenser 3. Water and a portion of chemical 13 move through filter 9 and through existing faceplate 14. Filter 9 is preferably stretchable and this provides several benefits. Because the filter is relatively small to cover an existing faceplate small filters clogs rapidly. In one embodiment of the present invention as filter 9 accumulates debris such as hair and dead skin the filter starts to clog. In one embodiment of the present invention as filter 9 clogs water pressure out the output jets 75 (not shown) starts to decrease. However, with water suction draw filter 9 stretches allowing less pressure drop to output jets 75. Filter 9 is shown by way of example and not limitation as many other types of filters could be used, even screen filters or filters that can filter out bacteria. In one embodiment of the present invention filter 9 also provides a barrier between cover 2 and existing faceplate 14. This barrier prevents hair from becoming entrapped in existing faceplate openings 16. There is no prior art for a filter that provides a barrier to an existing faceplate to prevent hair entrapment except for the current invention. Chemical chamber 3 could also be located adjacent to the front surface of cover 2. Filter 9 could be impregnated with an antimicrobial additive.

Figure 4:
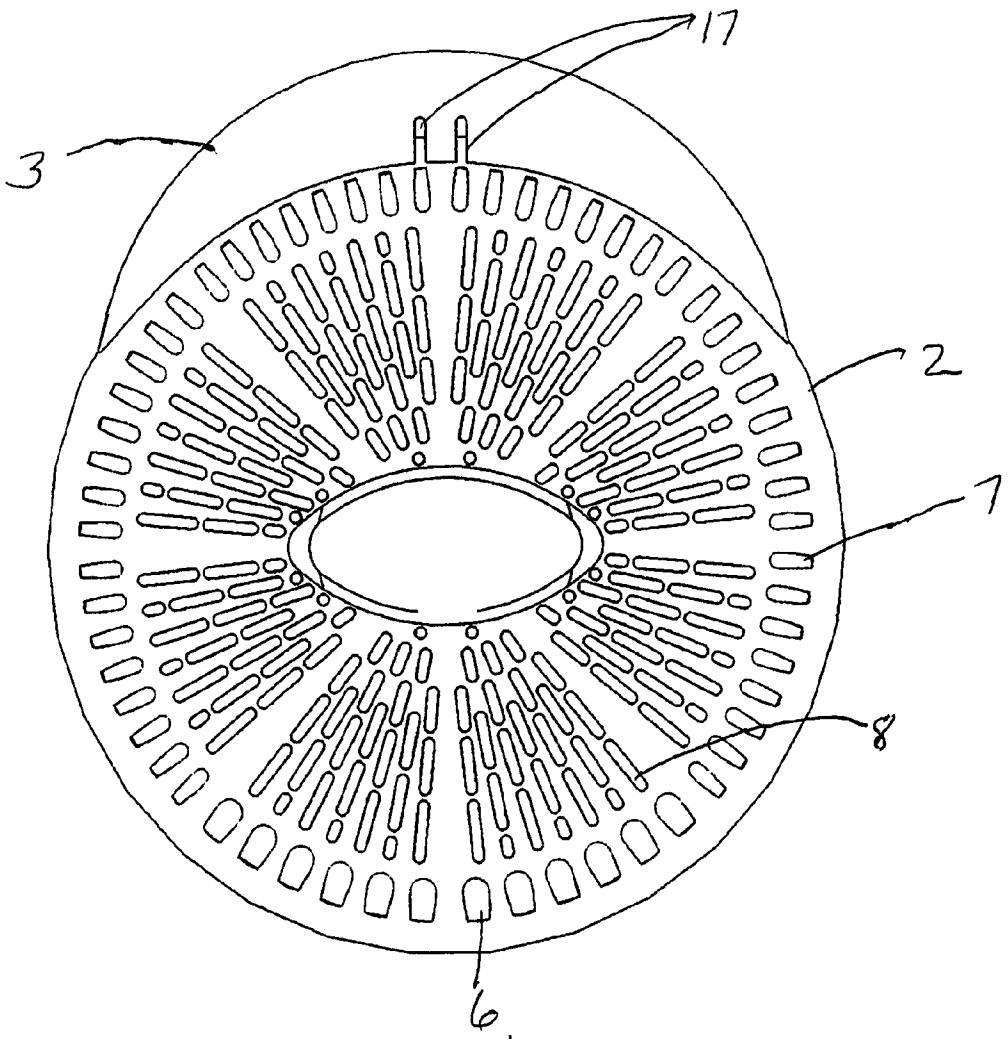
FIG. 4 is a front view of an inventive cover with a chemical chamber attached to the front surface of the cover.
Figure 5:
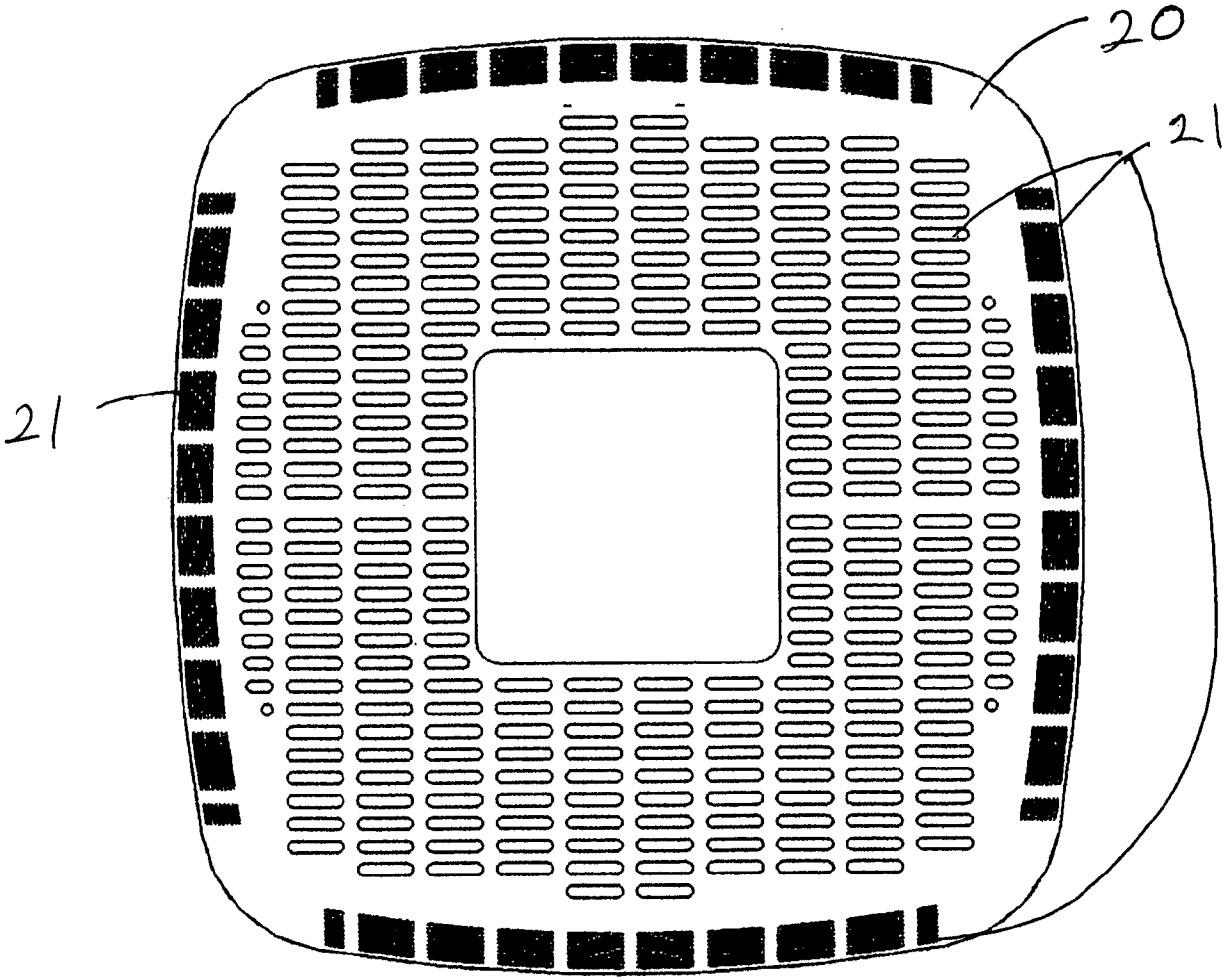
FIG. 5 is an embodiment of a square inventive cover.

Referring next to FIG. 4 shows cover 2 having front water flow through opening 8, side water flow through opening 7 and lower water flow through opening 6. In one embodiment of the present invention chemical dispenser 3 has chemical release openings 17. As water (not shown) flows by chemical release openings 17, water contacts chemical 13 (not shown) and a portion of chemical 13 leaves chemical dispenser 3 and is drawn through cover 2 and into a suction line of a water vessel (not shown). In one embodiment of the present invention chemical release openings 17 are calibratable to a given water flow and tub capacity. As an example, higher water flows would mean smaller openings to achieve a desired metered dose of chemical to release from chemical dispenser 3. Conversely, a lower water flow contacting the chemical would require a larger opening to deliver the same-metered dose. Using Bromine or Chlorine as a chemical it is preferable that chemical release openings 17 are calibrated for a given water flow and tub capacity to deliver a metered dose of less than about 10 parts per million concentration after mixing with water in a tub in a given bath cycle. In other words, if the tub had 100 gallons capacity and the water flow is 90 gallons per minute through cover 2, and the bath cycle takes 30 minutes, and less than 10 parts per million concentration of chemical is desired after mixing water in the tub at the end of 30 minutes, the openings 17 would be calibrated for this scenario. Openings 17 are shown by way of example and not limitation. Chemical dispenser 3 could have one or more openings in one or more locations and in one or more configurations. The sizing of chemical dispenser 3, openings to deliver a metered dose are shown by way of example and not limitation. There are numerous ways to deliver a metered dose such as using an adjustable chemical dispenser and all ways fall into the scope of the current invention. The combination of the current inventions cover, filter, chemical dispenser accommodates water flows from 70 gallons per minute up to and exceeding 200 gallons per minute and the combination of cover, filter and chemical chamber or there separate parts will increases the vacuum on a suction line (not shown) leading to a water pump (not shown) by less than about 5" Hg. Additionally, this said combination restricts a jet output pressure by less than 35%. Cover 2 could also have an attachment means to attach cover 2 to a suction housing. Referring next to FIG. 5 shows one embodiment of the current invention's Cover 20. Cover 20 has water flow through openings 21. Cover 20 is designed to fit over an existing faceplate.

Figure 6:
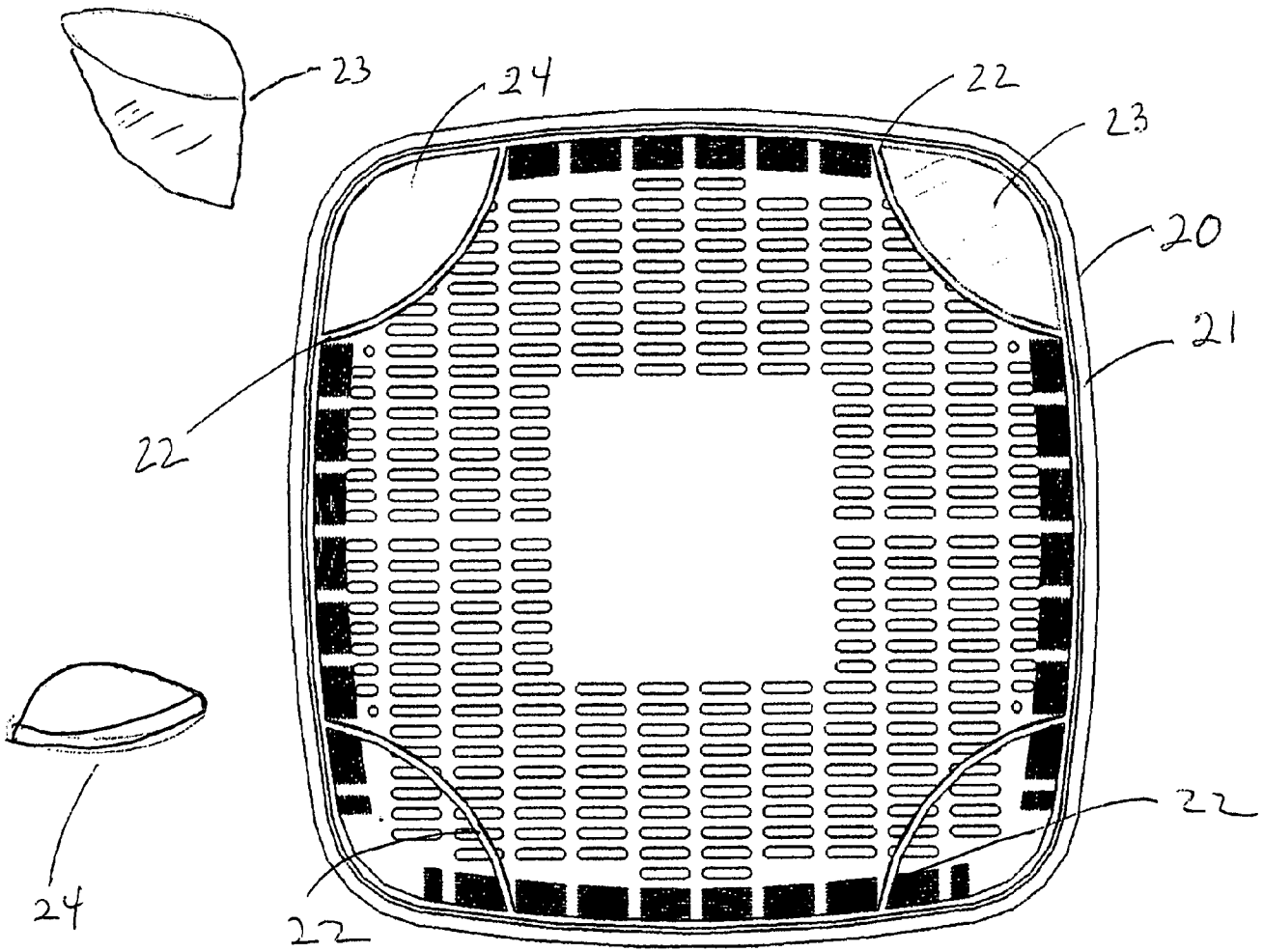
FIG. 6 is a rear view of a square inventive cover having chemical chambers.

Referring next to FIG. 6 shows the rearview of cover 20. Cover 20 has filter support 21 shown attached to cover 20 that secures filter 9 (not shown) to cover 20. Chemical dispensers 22 hold a chemical tablet. Chemical dispenser 22 is attached to the sidewall of cover 20 and not the front wall of cover 20. However, chemical dispenser 22 could be located anywhere on cover 20 as a single chemical chamber or in multiples. Chemical dispenser cap 24 covers chemical dispenser 22. Chemical tablet 23 is shown by way of example and not limitation. Chemical tablet 23 could be any chemical, substance or element that has bacteria inhibiting properties. Chemical dispenser 22 could have any number, shape and configuration of chemical release openings to release a metered dose. A person of ordinary skill in the art from reading this disclosure would know how to configure chemical release openings to achieve the goals of the current invention.

Figure 7:
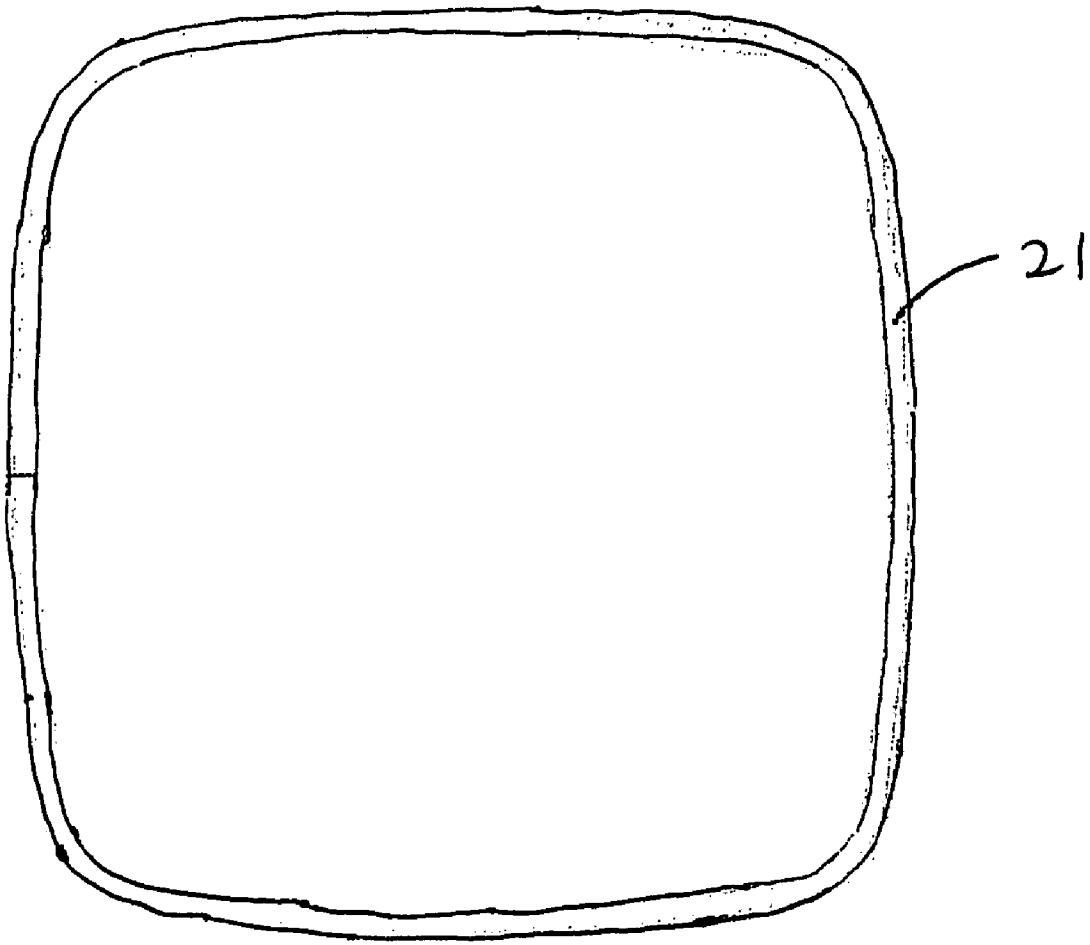
FIG. 7 shows a front view of a support member for a filter.

Referring next to FIG. 7 shows filter support 21.

Figure 8:
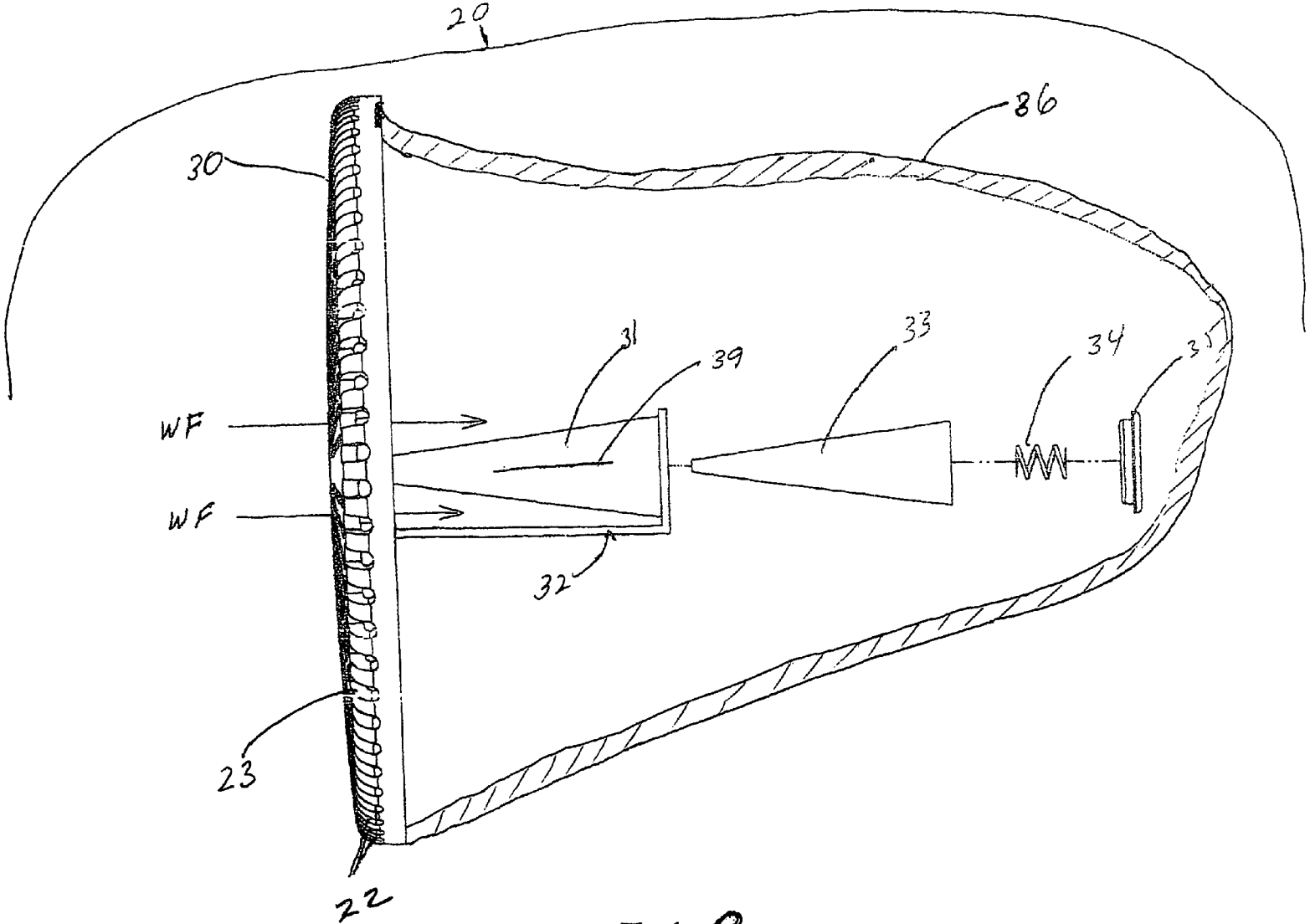
FIG. 8 shows a side view of a sanitation assembly and a cross section view of a filter attached to a cover.

Referring next to FIG. 8 shows sanitation assembly 20 having cover 30. Chemical chamber 31 attached to chemical support arm 32 whereby support arm 32 is attached to cover 30. Filter 86 (cross section view) is attached to cover 30. Chemical 33 fits into chemical chamber 31 and spring 34 keeps chemical 33 against chemical release opening 39 as water (not shown) erodes chemical 33. Cap 35 covers chemical chamber 31. As water (not shown) flows through openings 23 and 22 in cover 30, the water impacts chemical 33 housed in chemical chamber 31. A metered portion of chemical 33 releases and enters into a closed loop plumbing system (not shown). In all embodiments of the current invention a sufficient amount of chemical releases into water to inhibit bacteria growth in a water vessel having a closed loop piping system (not shown). The amount of chemical released can be in sufficient amounts to leave a residual in a closed loop plumbing system to inhibit bacteria growth in at least a segment of a water vessel between water vessel pump activation and/or between water vessel usages. The covers herein are shown by way of example and could have a single water flow through passage.

We claim:

1. A safety device for a whirlpool bathtub, a spa, or a swimming pool having a suction device, the safety device comprising:

a perforated cover having water flow through passages;

a filter media having a front surface and a rear surface, the rear surface of the filter media is configured for direct abutment with an existing faceplate of a suction fitting and for placement in a parallel manner to the cover and the faceplate so as to have the same water flow direction from the front of the water flow through passages to the back of the existing faceplate, the filter media is configured to about the size of the existing faceplate, the filter media is capable of accommodating a high velocity water flow, the filter media is configured to not restrict water flow out a water return fitting by more than 35% when the high velocity water flow is passing through the filter, the filter media is configured to filter debris that provides a source for bacteria growth in a closed loop piping system, the filter media is configured to prevent hair from going through the filter in a manner to get entrapment in the existing faceplate; and means functioning to keep the filter media in direct abutment with the existing faceplate and to keep the cover and the filter media mounted in a parallel manner to the existing faceplate until a user removes the filter media from the existing faceplate.

2. The cover of claim 1, wherein the filter contacts the water flow through openings of the existing faceplate when water is passing through the filter.

3. The cover of claim 1, wherein the filter media is configured to conform to about the shape of the existing faceplate covering all water flow through passages in the peripheral edge of the existing faceplate when water is passing through the filter.

4. The cover of claim 1, wherein the filter media is about the size of the existing faceplate and accommodates water flow of 70 gallons per minute.

5. The cover of claim 1, wherein the filter media is about the size of the existing faceplate and accommodates water flow of over 80 gallons per minute up to 200 gallons per minute.

6. The cover of claim 1, wherein the filter media is flexible and configured to filter all water goes therethrough before entering the existing faceplate.

7. The cover of claim 1, wherein the filter media is flexible.

8. The cover of claim 1, wherein the means functioning to keep the cover on the existing faceplate comprises a hook and loop type material.

9. The cover of claim 1, wherein the filter media is made out of a material that stretches.

10. The cover of claim 1, wherein the filter media is configured to snuggly fit over the existing faceplate.

11. The cover of claim 1, wherein the filter media is about the size of the existing faceplate for accommodating about 70 gallons per minute water flow and configured to increase vacuum pressure on a suction line by less than 5 inches of mercury.

12. The cover of claim 1, wherein the whirlpool bathtub, spa, or swimming pool further comprises a water pump draws water in through the front surface of the filter, in a direct line through the water passages in the front surface of the existing faceplate.

13. The cover of claim 1, wherein the filter media is non-pleated and substantially flat.

* * * * *